US005911171A

United States Patent [19]

Wong

[11] Patent Number: 5,911,171

[45] Date of Patent: Jun. 8, 1999

[54] PICKUP SYSTEM FOR BRIDGE OF STRINGED MUSICAL INSTRUMENT

[76] Inventor: Ka Hei Wong, 101 Grassy Plain Rd., East Providence, R.I. 02915

[21] Appl. No.: 09/039,343

[22] Filed: Mar. 13, 1998

[51] Int. Cl.[6] ..... G10D 1/02; G10D 3/04; G10H 3/18

[52] U.S. Cl. ..... 84/731; 84/274; 84/307; 84/309; 84/DIG. 24

[58] Field of Search ..... 84/731, 264–289, 84/307–311, DIG. 24

[56] References Cited

U.S. PATENT DOCUMENTS

| | | | |
|---|---|---|---|
| 3,291,887 | 12/1966 | Carmen et al. | 84/731 |
| 3,325,580 | 6/1967 | Barcus et al. | 84/731 |
| 4,147,084 | 4/1979 | Underwood | 84/DIG. 24 |
| 4,356,754 | 11/1982 | Fishman | 84/DIG. 24 |
| 4,785,704 | 11/1988 | Fishman | 84/DIG. 24 |
| 5,223,660 | 6/1993 | Wahlgreen | 84/731 |

*Primary Examiner*—Stanley J. Witkowski
*Attorney, Agent, or Firm*—Robert J Doherty

[57] ABSTRACT

A bridge for stringed instruments having a central slotted opening for receipt of the blades of a pickup device such that the blades are adapted to move laterally back and forth and forwardly and back within the opening so as to vary the sound achieved by the bridge.

9 Claims, 4 Drawing Sheets

PICKUP SYSTEM FOR BRIDGE OF STRINGED MUSICAL INSTRUMENT

Reference is made to Document Disclosure No. 422,127 filed Jul. 24, 1997.

FIELD OF THE INVENTION

This invention relates to a stringed musical instrument and more particularly to the construction of the bridge thereof. A piezo electric transducer movably positioned in the bridge may be utilized to vary the acoustical qualities of the signals picked up by the bridge from the strings supported thereon. In describing the present invention, reference will be made to its use with a violin or viola but the invention may also be used in association with other stringed musical instruments of the type which use bridges to support their strings.

BACKGROUND AND OBJECTS OF THE INVENTION

Various piezo electric pickup or transducer systems or devices are utilized in conjunction with the bridges of stringed instruments including those constructions shown in the following U.S. patents: U.S. Pat. No. 3,291,887 to F. C. Carman et al issued Dec. 13, 1966; U.S. Pat. No. 3,325,580 to L. M. Barcus et al issued Jun. 13, 1967; U.S. Pat. No. 4,147,084 to D. E. Underwood issued Apr. 3, 1979; U.S. Pat. No. 4,356,754 to L. R. Fishman issued Nov. 1, 1982; U.S. Pat. No. 4,785,704 to L. R. Fishman issued Nov. 22, 1988; and U.S. Pat. No. 5,223,660 to H. Wahlgreen issued Jun. 29, 1993.

As shown by these patents and as is generally known in the violin art, generally planar bridge constructions are mounted upright on the upper surface of the instrument outer shell or body and are utilized to support the instrument's strings at their upper edge surface. When the instrument is played as by a bow or plucked by the fingers, vibrations are created which are transmitted through the bridge and thence to various piezo electric pickup or transducer devices mounted at various locations in or associated with the bridge itself. Examples of typical bridge constructions are shown by the previously referred to patents of Underwood, Barcus et al, Carman et al and Fishman. A standard bridge thus includes a central body having an upper edge for contacting the instrument's strings and a pair of sides which are generally interrupted with inwardly extending scroll cuts to in part define a pair of legs which in turn contact the upper surface of the instrument shell.

In addition to the side openings or scroll cuts, a central scroll cut is normally positioned in the bridge. The above indicated patents also show that various placements of the pickup device with respect to the bridge are known and include placement in the side openings between the main portion of the bridge and the legs thereof and in the upper portion of the bridge body between the central scroll cut and the upper edge thereof. Various pickup elements are also utilized such that the attachment of the pickup to the bridge is facilitated including opposed flexible blades such as shown in Fishman.

While the above constructions and pickup systems and bridges are generally satisfactory, there remains a need for a system which will generate rich overtones especially in high dynamic ranges and in correct phase and a bridge which can be played hard and reduces or eliminates the disadvantages of feedback. It is also desirable to be able to, in effect, tune the bridge to the player's or audience's preferences, that is, achieve the effect of using various shapes, sizes and materials to achieve different tones, sounds and the like yet not undergo the expense and time of so doing.

SUMMARY OF THE INVENTION

It has, accordingly, been discovered that the above indicated advantages can be achieved with a single piezo element pickup system by providing a bridge for a stringed instrument having a body on which said bridge is supported in a generally upstanding position, said bridge including a planar body including an upper surface for supporting the instrument strings and opposed side surfaces each in turn including inwardly extending side openings laterally spaced from each other so as to define a central bridge area between said side openings, a laterally extending centrally disposed slotted opening disposed in said central bridge area and having opposed facing upper and lower opening defining surfaces, said slotted opening adapted to frictionally receive a pickup device including a piezo electric sensing element such that said pickup device may be adjustably laterally and forwardly and rearwardly moved with respect to said slotted opening so as to vary the properties of the acoustic signals received by said pickup device via movement of the instrument strings.

Other objects, features and advantages of the invention shall become apparent as the description thereof proceeds when considered in connection with the accompanying illustrative drawings.

DESCRIPTION OF THE DRAWINGS

In the drawings which illustrate the best mode presently contemplated for carrying out the present invention.

DETAILED DESCRIPTION OF THE INVENTION

Figure 1:
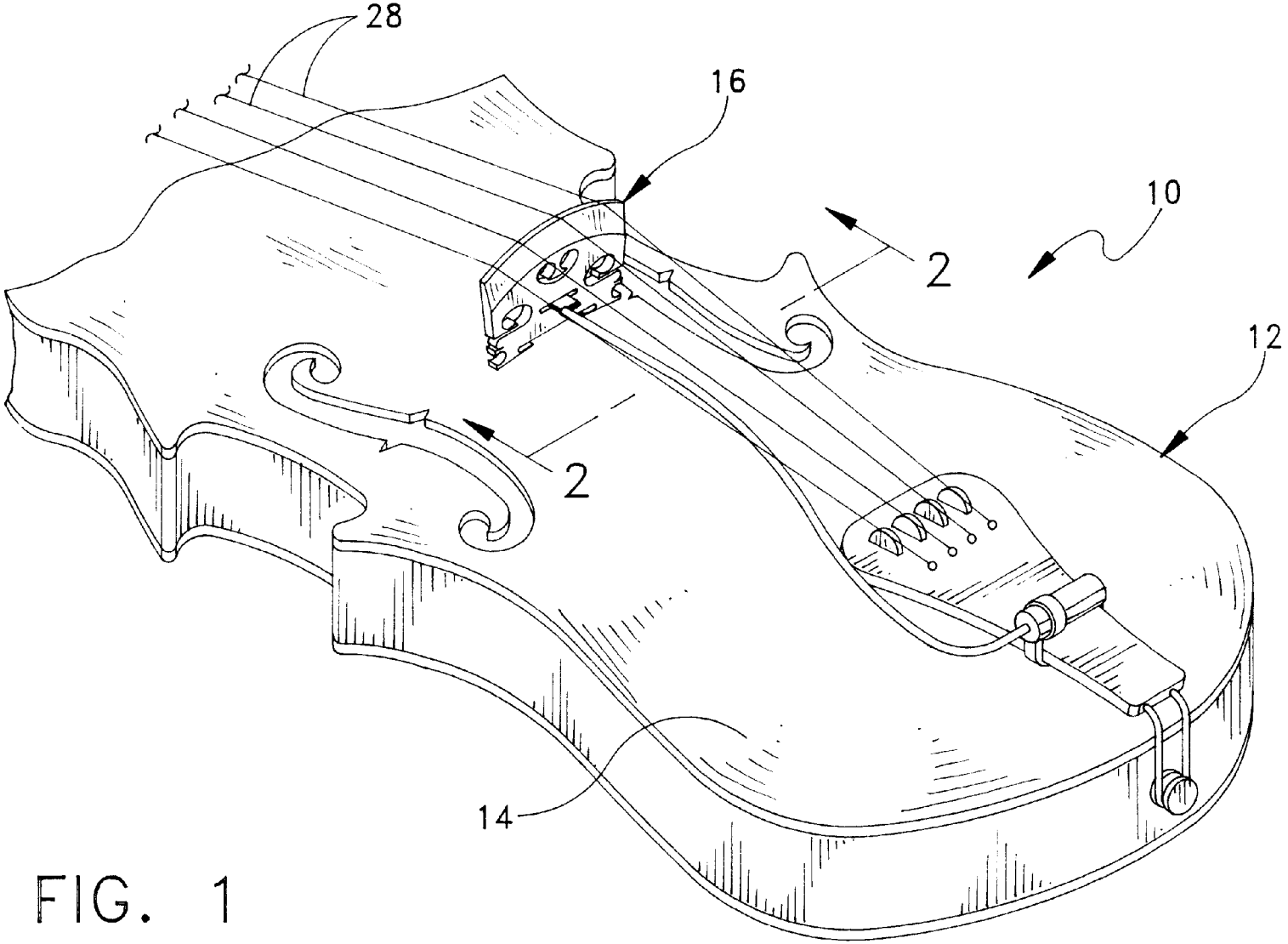
FIG. 1 is a perspective view showing a stringed musical instrument in the form of a violin with a piezo electric transducer secured in the central slotted bridge opening.
Figure 2:
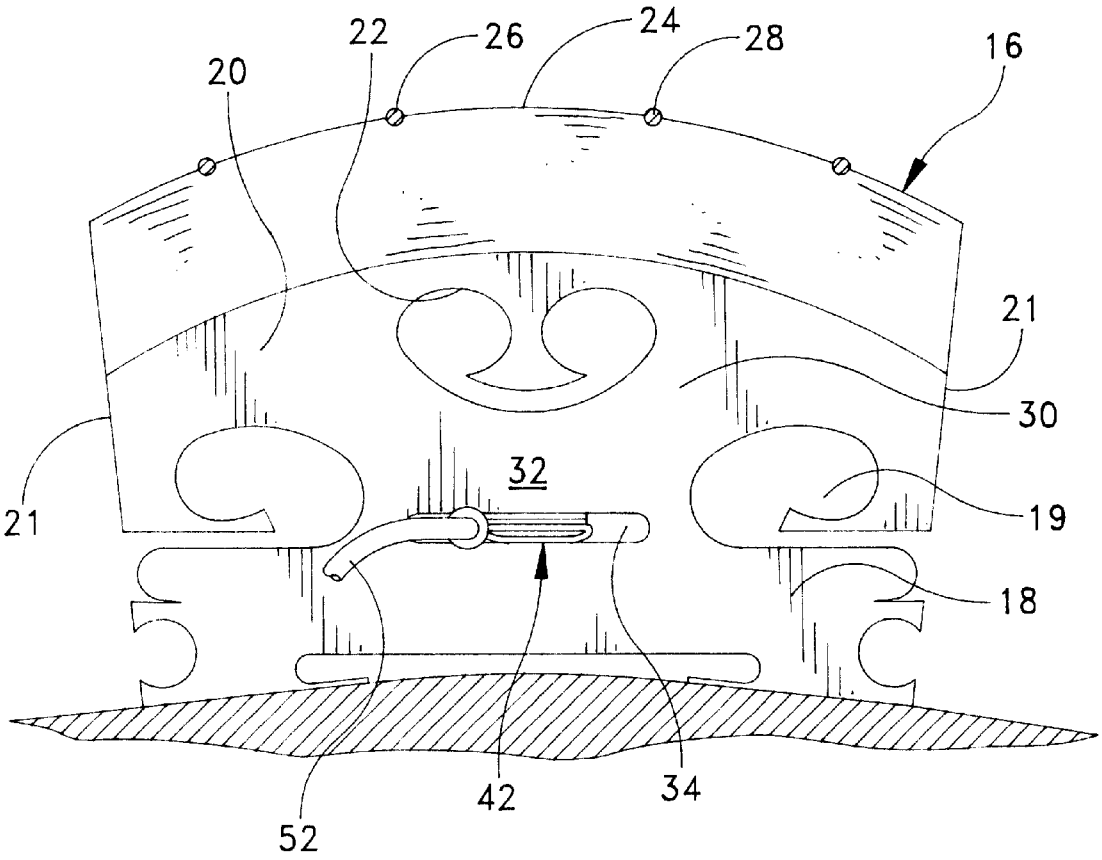
FIG. 2 is an elevational view taken along the line 2—2 of FIG. 1 showing more specific details of the placement of the transducer and the bridge construction.
Figure 3:
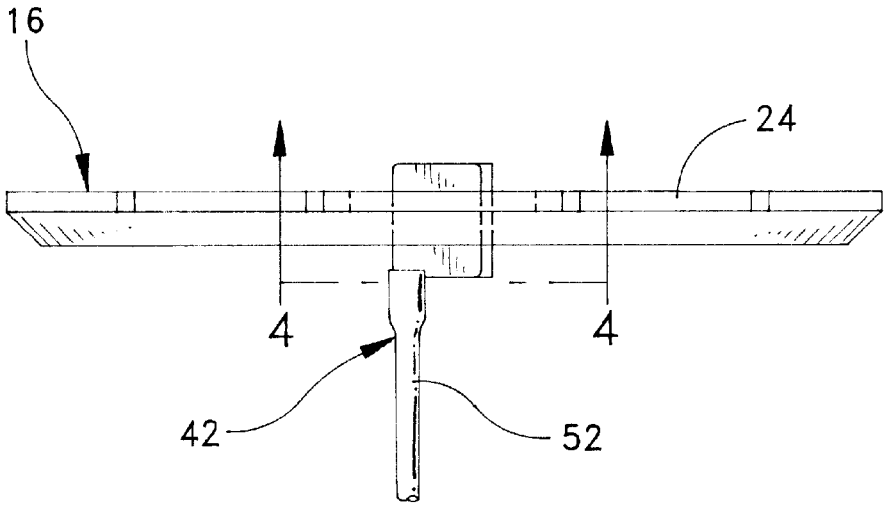
FIG. 3 is a top plan view of FIG. 2.
Figure 4:
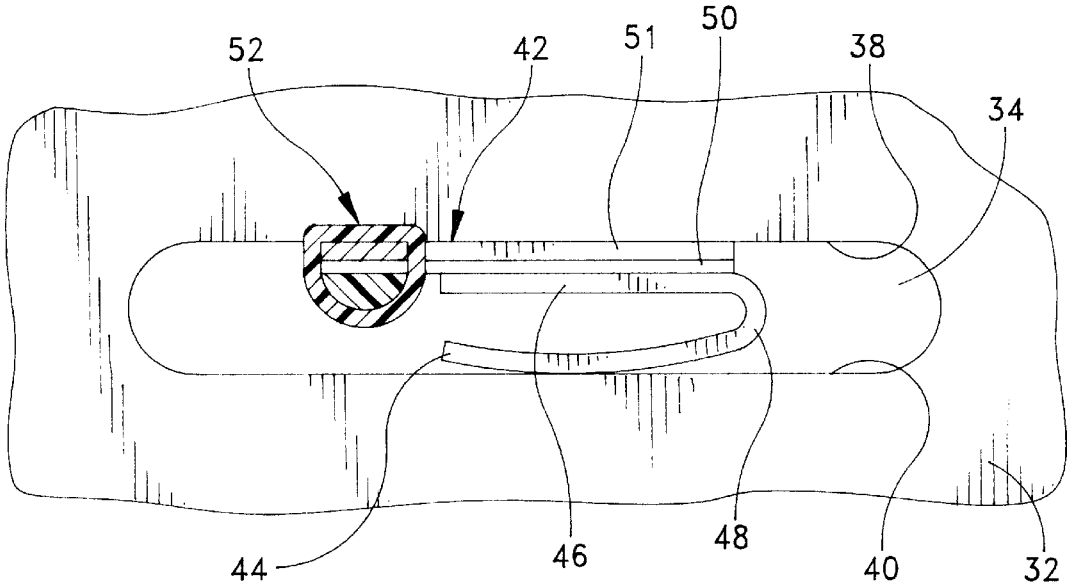
FIG. 4 is a cross-sectional view taken along the line 4—4 of FIG. 3 illustrating the manner in which the transducer utilizes spring blades for biasing the pickup in the intended position vis-a-vis the slotted central opening.

Referring to the drawings and more particularly to FIGS. 1 through 3 thereof, a violin 10 is partially shown which includes a case, body or shell 12 having an upper surface 14 on which the instrument bridge 16 is supported in an upright position by conventional means. Except as otherwise noted, this bridge 16 is of conventional construction, e.g., is made of wood and includes a pair of legs 18 in part defined by a pair of inwardly extended slotted scroll cuts or openings 19 inwardly extending from the sides 21 thereof. The main body portion 20 of the bridge includes a central scroll cut or opening 22 and the upper surface or edge 24 of the bridge may include notches 26 for receipt of the strings 28.

The areas of the bridge disposed between the slotted side openings 19 and the central scroll opening 22 are referred to as pillars 30 and, in effect, by being of reduced lateral extent form springs that are somewhat flexible and thus in part is believed to achieve some of the tonal qualities of bridges. It is in this central area 32 between the side slotted openings 19 and the central scroll slot that the slotted opening 34 of the present invention is disposed in a generally lateral, that is, side to side, direction. There may be more than one, e.g., a pair or more, slotted openings 34 in this central area, and the opening or openings may also be angularly disposed, curved in line or vertically above each other and in this regard, the term "slotted opening" should be construed to be singular or plural and to also include the above referred to alternatives. Such slotted opening 34 includes opposed end walls 36 and upper and lower walls 38 and 40 in turn spaced from each other and adapted to receive the transducer element of the present invention. Also in some cases, the scroll cuts or openings 19 may be omitted and in such cases the central area 32 as above referred to is between the sides 21.

Such transducer element or pickup 42 may be of many commercially available constructions, e.g., including the construction shown by U.S. Pat. No. 4,785,704 to Fishman being satisfactory for such purpose. For the purpose of describing the construction of such a transducer as well as the manner in which the signal thereof is amplified and otherwise utilized for the purpose of this invention, the disclosure of such Fishman '704 patent is hereby incorporated into the present application by specific reference thereto.

Figure 5:
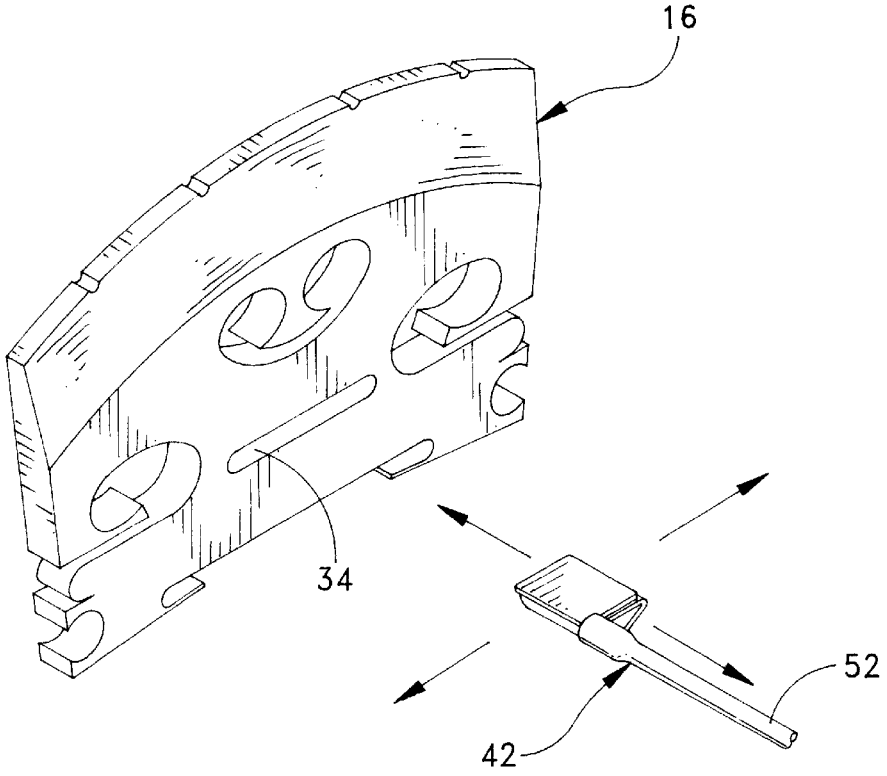
FIG. 5 is an enlarged scale perspective view showing a stylized rendering of the central slotted opening of the bridge and the manner in which the transducer may be adjustably mounted with respect thereto.

In essence, the pickup 42 includes a pair of electrically conductive metal blades 44 and 46 which are interconnected at a common point, e.g., a bent edge 48 to set up a spring relationship between the blades, and the upper blade 46 includes a piezo electric crystal 50 and electrically conductive cover 51 so that such operates in the intended manner. In addition, the width of the transducer element or at least the blades thereof should be materially less than of the width of the slotted opening 34 such that the blades of the element can be inserted into the slotted opening 34 and moved laterally within the confines of the slotted opening, that is, from side to side, so as to determine the best sound pickup position for a particular instrument and bridge set. In addition, the pickup should be adapted to move inwardly and outwardly with respect to the slot, that is, forwardly and rearwardly and at various angular directions as shown by the arrows of FIG. 5 for the same purpose. Additionally, the pickup can be rotated so that its lower blade is uppermost and the upper blade to which the piezo electric plate is attached is lowermost and at that alternate general position can be moved laterally from side to side and inwardly and outwardly as referred to above until the most desired or particular sound for any particular purpose is achieved in that location. The flexible nature of the blades enables the pickup device once positioned to stay in that position without the need for being permanently affixed to the opposed surfaces of the slotted opening although such may be achieved by glue or otherwise if it is decided that is the permanent location desired. Also, the opening 34 can be oversized such that two or more pickups can be placed and moved as above described therein.

Figure 6:
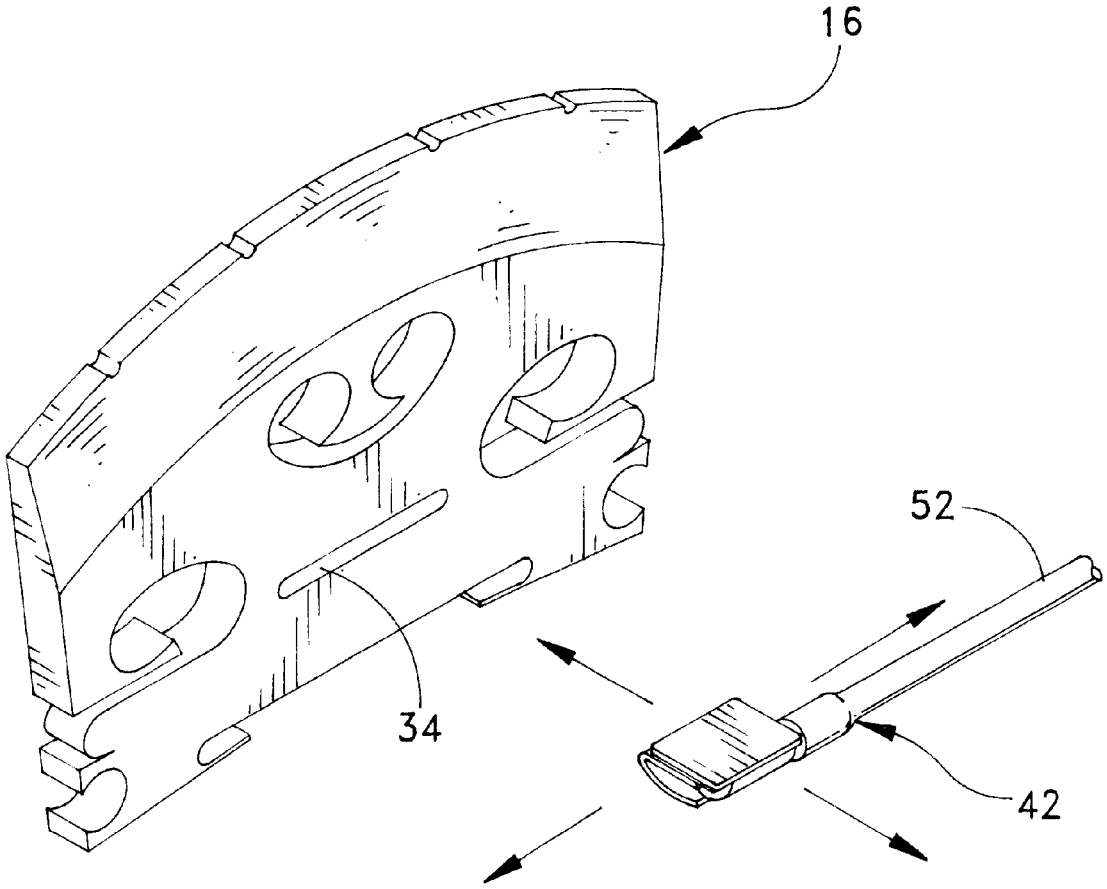
FIG. 6 is a view similar to FIG. 5 but showing the transducer shifted 90°.

Turning to FIG. 6, the pickup 42 has been rotated 90° and the bent edge 48 of the blades 44 and 46 inserted into the opening 34 and moved in the same manners as described with regard to FIG. 5 at least to the extent permitted by the placement of the electrical lead 52.

Although the exact scientific theory through which the improved and variable sound is achieved by the above described system is perhaps not completely understood, the following description of a single piezo element pickup, its advantages, disadvantages as well as the advantages and disadvantages of multiple piezo pickups and magnetic pickups is discussed below:

First let us look at the different types of pickups available and discuss the inherent advantages and disadvantages of each. The theory behind the piezo element is quite simple. Excitation (vibration from string movement) will cause the piezo crystal to flex. The flex causes the molecular structure to move and energy is generated. This electrical energy given out by the crystal is the signal used to feed the amplifier. All piezo crystals work the same way. Some are more efficient at certain frequencies than others. Also tonal quality can vary depending on how the piezo is mounted in the bridge.

Single Piezo Pickup

This type has been used successfully by several manufacturers, i.e., Barcus Berry, L. R. Baggs and Fishman.

Advantages:

The advantages of the single piezo pickup are that it produces a) Rich Overtones: The piezo will pick up all fundamental and harmonic vibrations—both those created by the strings and those reflected by the body of the instrument; b) High Dynamic Range: Using a conventional bridge provides a stiff support for the string and little energy is lost between the string and piezo even during hard play; c) Flexible Bridge Profile: Since most single piezo systems use a conventional bridge, the bridge profile can be easily tailored to accommodate different playing styles; and d) Correct Phasing: In an acoustic instrument, the sound is generated by the string and mixed in the bridge, then the overall vibration is transmitted to the top of the violin. The bridge acts like an equalizer and a mixer at the same time so by placing the one piezo at a strategic location the phase relationship between different frequencies can be faithfully duplicated especially when playing double or triple stops.

Disadvantages:

a) Feedback: It is ironic that an advantage can also be a disadvantage. When played at high volume, the body of an acoustic violin outfitted with a single piezo pickup will pick up acoustic energy (act like a microphone) and cause feedback. There are a number of ways to minimize the feedback problem: 1) The use of electronics to notch out the feedback (disadvantage is more hardware); 2) Decouple the bridge from the body by using damping material under the bridge (disadvantage is dry tone, harsh sound); 3) Deaden the acoustic character of the violin by filling the hollow body with foam (disadvantage—you would not do this to a good violin . . . period); and 4) Build a solid body (disadvantage—the solid body, unlike the acoustic body, cannot be tuned with a sound post; and if the solid body is not inherently tuned, the sound will be inconsistent); b) Optimal Piezo Placement: The piezo must be placed at a point where it is at equal acoustic distance from each string (note: the acoustic distance is not merely the linear distance from the piezo to a string—it involves also the angle orientation of the piezo relative to the string and the properties of the material between the piezo and the string). The above conditions must be met in order for all strings to have even volume. The multi-element piezo pickup bridge is devised primarily for this reason.; and c) Low Output: A low output level will result if the piezo is placed too far away from the strings and/or in an area of the bridge which is too dense (dead) to transmit vibration to the piezo.

Multi-Piezo Pickup

This kind of pickup consists of at least one piezo element per string. Each element is devoted to pickup vibration from one particular string. This kind of pickup bridge system is usually setup in such a way that the piezo is decoupled from the adjacent string and the violin body. This is necessary to avoid phase cancellation (between piezo elements) and resulting inconsistent output level.

Advantages:

a) Even Output for Different Strings due to equal acoustic distance; b) High Output due to the fact that the piezo can be placed very close to the string and receive maximum vibration; and c) No Feedback from the Violin body: Each piezo is decoupled (isolated) from the violin body and other strings. This set up negates the existence of the violin body so the designer can concentrate on the styling and not have to address the acoustic (nodal) issue of the violin. (I have measured the piezo to pickup vibration from adjacent strings at −20 db).

Disadvantages:

a) Lack of Overtones (harmonics): Since each string is decoupled from the violin body at −20 db, all the signal is generated solely by the string. Some pickups do have some very warm overtones which are generated by the piezo housing itself and not by the naturally resonating violin body; b) Low Dynamic Range: Ideally the harder you play, the stronger the signal should be. In the multi-piezo bridge, the decoupling is done by putting separation slits in the bridge so the movement of each piezo is independent as possible. However with these slits in the bridge, the support for each string is greatly weakened. When played hard, the piezo housing will begin to flex beyond its operating range and much of the energy will be lost. (A good analogy would be fanning oneself with a piece of paper—the piece of paper at high speed will not mimic the movement of one's hand; it will make a lot of noise and not much air flow.) Hence, the output of an isolated piezo housing will saturate at a certain level and cease to give the higher output that the player desires.; c) Incorrect Phasing: In a conventional bridge, the phase relationship of each string is handled in a way that produces classical sound. In a multi-piezo setup, the bridge geometry is vastly different and the mixing of sound is not being done mechanically but by means of electrical connection. This can alter the character of the sound.; and d) Non-Flexible Bridge Profile: In most multi-piezo systems, the bridge profile is predetermined which eliminates the possibility of accommodating different playing styles, i.e., classic vs. blue grass.

Magnetic Pickup

Basically, magnetic pickups use the string as an inductor. When this inductor moves across the magnetic field, an electrical energy is generated.

Advantages:

a) No Overall Feedback. The magnetic pickup will not pick up any acoustical content. It will only pick up string movement which affords the builder freedom of instrument styling as with multi-piezo systems.

Disadvantages:

String to magnetic coil distance is extremely critical and the following factors can be affected: a) Non-Linear Gain: Upon bowing, the distance from string to coil changes and the overall gain can be affected. When playing hard, the increase in volume may be exaggerated and this would occur as the naturally greater string excursion (which produce more volume) couples with closer string to coil proximity (adding additional volume).; b) Non-Flexible Bridge Profile: The bridge must be designed to insure even string to coil distance.; and c) No Overtones: The electrical signal is solely generated by the string and the sound will resemble that of an electric guitar.

In the final analysis, the design criteria of acoustic sound quality with no feedback at any playing volume, with ergonomic design including items such as chin rest, shoulder rest and bridge profile can be outfitted in the same way as an acoustic violin. There is no need to adapt or get used to the instrument because it is a violin and with the use of a conventional bridge and no wires produces excellent and flexible sound production through the use of the subject invention. In part, this is achieved by utilizing an otherwise conventional bridge which plays a large part in determining the sound of the violin, i.e., the complex sound mixing that the bridge does has taken over 400 years to evolve and still there is no better way to mix sound.

To make an electric violin that will make sound is easy—to make one which sounds like any other is just as easy. Some electric violin designers only concentrate on the styling of the instrument and pay little or no attention to the acoustic properties. To them, the sound is solely dependent on the choice of pickup, and it is quite a self-fulfilling prophecy (refer to the above section on multi-piezo element and magnetic pickups). The multi-piezo pickup will sound the same regardless of violin geometry. The acoustic contribution is thrown out by the inherent nature of the pickup. To use a single piezo pickup causes more problems than it solves. But believing that the single piezo system produces the most natural acoustic sound, the present inventor chose to look into the problems and take action. In an electric violin, there is no sound post to adjust. The present inventor had to be very exacting in solving all the problems associated with the single element setup. The bridge of the present invention assures even gain throughout the entire tonal range of the instrument. The bridge allows for fine adjustment of the single piezo element to find its sweet spot (optimal acoustic placement point) as shown in FIG. 1. The adjustable feature works much like the sound post of the acoustic violin. The fine adjustment is extremely crucial since different bridge profiles will affect the location of the sweet spot. To provide a sound with rich overtones, great care was utilized in designing the body to behave like that of an acoustic instrument. It even has an acoustic chamber to generate overtones and a rich wooden sound. The bodies were carefully dimensioned to strike the optimal balance for acoustic sound without the disadvantage of acoustical feedback.

While there is shown and described herein certain specific structure embodying this invention, it will be manifest to those skilled in the art that various modifications and rearrangements of the parts may be made without departing from the spirit and scope of the underlying inventive concept and that the same is not limited to the particular forms herein shown and described except insofar as indicated by the scope of the appended claims.

What is claimed is:

1. In combination, a stringed instrument comprising an instrument case, a bridge supported from the case and including an upper surface for supporting the strings, said bridge further including opposed sides each including an inwardly extending side opening, said side openings laterally spaced from each other so as to define a central bridge area between said side openings, a laterally extending central slotted opening disposed in said central bridge area and having opposed upper and lower opening defining surfaces, and a pickup device including a piezo electric sensing element frictionally disposed in said central slotted opening and in contact with said upper and lower surfaces, the lateral width of said pickup device less than that of said central opening such that the pickup device may be adjustable laterally moved within said central slotted opening.

2. The assembly of claim 1, said pickup device including a pair of generally flat blades attached to each other and disposed for flexible pivotal movement towards and away from each other, said blades in contact with said upper and lower central slotted opening surfaces.

3. The combination assembly of claim 1, said bridge including a scroll cut opening positioned above said central slotted opening.

4. The combination assembly of claim 3, said slotted central opening disposed below said scroll cut opening.

5. The combination assembly of claim 1, including a plurality of said slotted central openings laterally separated from each other within said central area and disposed between said side openings, each of said slotted central openings in receipt of a separate pickup device.

6. A bridge for a stringed instrument having a body on which said bridge is supported in a generally upstanding position, said bridge including a planar body including an upper surface for supporting the instrument strings and opposed side surfaces each in turn including inwardly extending side openings laterally spaced from each other so as to define a central bridge area between said side openings, a laterally extending centrally disposed slotted opening disposed in said central bridge area and having opposed facing upper and lower opening defining surfaces, said slotted opening adapted to frictionally receive a pickup device including a piezo electric sensing element such that said pickup device may be adjustably laterally and forwardly and rearwardly moved with respect to said slotted opening so as to vary the properties of the acoustic signals received by said pickup device via movement of the instrument strings.

7. The bridge of claim 6, said pickup device including a pair of generally flat blades attached to each other and disposed for flexible pivotal movement towards and away from each other, said blades in contact with said upper and lower central slotted opening surfaces.

8. A bridge for a stringed instrument having a body on which said bridge is supported in a generally upstanding position, said bridge including a planar body including an upper surface for supporting the instrument strings and opposed side surfaces laterally spaced from each other so as to define a central bridge area between said side surfaces, a laterally extending centrally disposed slotted opening disposed in said central bridge area and having opposed facing upper and lower opening defining surfaces, said slotted opening adapted to frictionally receive a pickup device including a piezo electric sensing element such that said pickup device may be adjustably laterally and forwardly and rearwardly moved with respect to said slotted opening so as to vary the properties of the acoustic signals received by said pickup device via movement of the instrument strings.

9. The bridge of claim 8, said pickup device including a pair of generally flat blades attached to each other and disposed for flexible pivotal movement towards and away from each other, said blades in contact with said upper and lower central slotted opening surfaces.

* * * * *